United States Patent [19]

Rohl et al.

[11] Patent Number: 4,923,075

[45] Date of Patent: May 8, 1990

[54] THERMOSTATICALLY CONTROLLABLE TANK CONTAINER

[76] Inventors: Jurgen Rohl, Horgensweg 6,, D-2000 Hamburg 54; Heinz Rode, Teilfeld 5,, D-2000 Hamburg 11, both of Fed. Rep. of Germany

[21] Appl. No.: 331,527

[22] PCT Filed: Aug. 2, 1988

[86] PCT No.: PCT/DE88/00476

§ 371 Date: Mar. 27, 1989

§ 102(e) Date: Mar. 27, 1989

[87] PCT Pub. No.: WO89/00962

PCT Pub. Date: Feb. 9, 1989

[30] Foreign Application Priority Data

Aug. 3, 1987 [DE] Fed. Rep. of Germany ... 8710599[U]

[51] Int. Cl.[5] ..... B65D 87/00

[52] U.S. Cl. ..... 220/5 A; 220/1 B; 220/428; 220/901

[58] Field of Search ..... 220/5 A, 1.5, 1 B, 85 S, 220/426, 428, 449, 469, 901

[56] References Cited

U.S. PATENT DOCUMENTS

| | | | |
|---|---|---|---|
| 1,494,979 | 5/1924 | Salisbury | 220/428 |
| 3,159,005 | 12/1964 | Reed et al. | 220/426 X |
| 3,688,940 | 9/1972 | Knight et al. | 220/428 |
| 3,776,414 | 12/1973 | Baker | 220/1 B X |
| 4,098,426 | 7/1978 | Gerhard | 220/901 X |
| 4,728,000 | 3/1988 | Gerhard | 220/1 B X |
| 4,756,447 | 7/1988 | Gerhard | 220/1 B X |

*Primary Examiner*—Steven M. Pollard
*Attorney, Agent, or Firm*—Staas & Halsey

[57] ABSTRACT

The thermostatically controllable tank container has a support structure with the dimensions of a parallelepipedic, standardized container. In the support structure (1) is provided a circular cylindrical tank (3) with a non-supporting thermal insulation jacket (4). Between the tank skin and the thermal insulation jacket are provided longitudinally directed ducts (9) for carrying a heating or cooling medium. The external diameter of the tank is essentially adapted to the internal dimensions of the square cross-section of the support structure, so that there is an optimum utilization by the cylinder of the theoretically available space of the parallepiped. The thermal insulation jacket adapted to the tank contour is arranged within the parallelepiped shape defined by the support structure (1). In cross-section, together with the circular cylindrical tank skin, the thermal insulation jacket (4) forms four crescent-shaped ducts (9) for carrying the heating or cooling medium and which are bounded in the longitudinal direction by the placing of the thermal insulation jacket on the circular cylindrical tank skin in the corresponding vertical and horizontal planes (tangents in cross-section). Thus, the invention provides a thermostatically controllable tank container with standardized external dimensions, whose internal space is utilized in optimum manner by the circular cylindrical tank. The four corners made available by the difference between the circle and the square are used for forming the crescent-shaped ducts. As the thermal insulation jacket (4) is also substantially circular, less insulating material is used in its manufacture.

6 Claims, 4 Drawing Sheets

THERMOSTATICALLY CONTROLLABLE TANK CONTAINER

Figure 4:
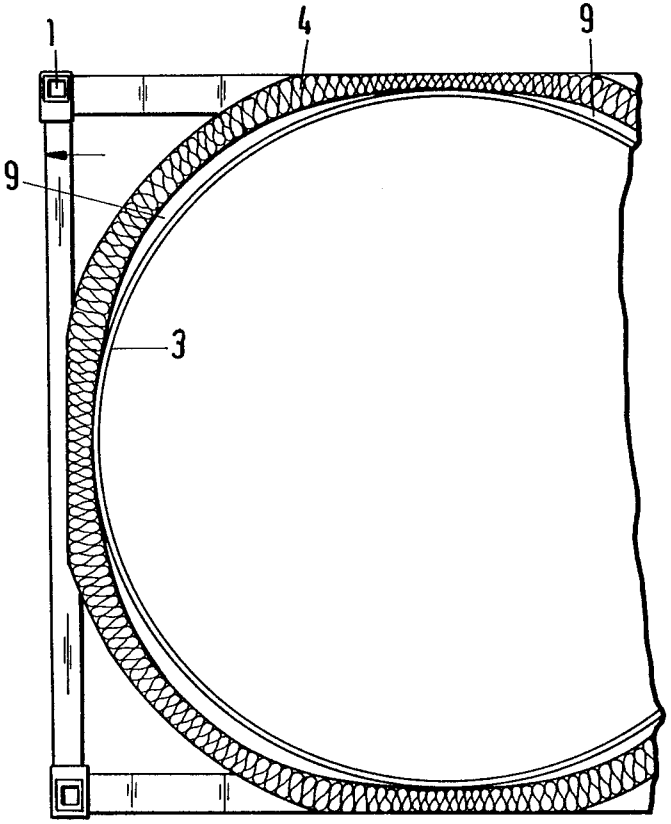

The invention relates to a thermostatically controllable tank container with a support structure, which fixes the external dimensions of a parallelepipedic container and serves as a support for a circular cylindrical tank, with a non-supporting thermal insulation jacket in the vicinity of the outside of the tank and in which between the tank skin and the thermal insulation jacket ducts are provided for carrying a cooling or heating medium along the tank skin serving as a heat exchange surface.

Such a thermostatically controllable tank container is known from German patent 29 17 364, whose tank is mounted in a support frame in such a way that the temperature control medium flows completely round it and the planar wall faces of the support frame are equipped with thermal insulation material. This known tank container is essentially a conventional, standardized, parallelepipedic container with vertical and horizontal, planar wall faces, in which is mounted a relatively small tank, so that a large amount of space is left between the planar wall faces and the circular cylindrical tank skin. Therefore the tank volume is relatively small compared with the internal volume of the parallelepipedic, standardized container. Preferably vertical walls or webs can be provided, which subdivide the space between the circular cylindrical tank skin and the vertical walls of the thermal insulation jacket into ducts for carrying the cooling or heating medium.

British patent 1 225 325 discloses a similar thermostatically controllable tank container, in which the thermal insulation jacket has a circular cylindrical cross-section and is spaced with respect to the tank. The spacing is defined by circumferentially distributed reinforcing rings, which simultaneously fix the ducts for the cooling and heating medium. The tank with its thermal insulation jacket is arranged in a support structure, which substantially forms a spatial latticework. Also in the case of this known tank container, the space which is defined by the support structure is only incompletely utilized as transportion space.

In addition, unheatable or uncoolable tank containers are known, which have a tank with a circular cylindrical cross-section. The cross-section of the tank is so large that it as far as possible completely utilizes the square cross-section fixed by the standardization of the container. A thermal insulation jacket is then fitted to the outer wall of the container without any gap. In the vicinity of the vertical and horizontal planes, i.e. at the "critical points", the thermal insulation jacket can be somewhat weakened, in order to ensure a maximum tank volume. However, this tank container is neither coolable, nor heatable.

The problem of the invention is to provide a thermostatically controllable tank container of the aforementioned type, in which the external dimensions fixed by the support-structure and standardization can be utilized in an optimum manner for the tank content and simultaneously a good and economic heating or cooling is ensured.

According to the characterizing part of the main claim this problem is solved in that the external diameter of the circular cylindrical tank substantially corresponds to the internal dimensions of the square cross-section of the support structure, that the thermal insulation jacket adapted to the contour of the circular cylindrical tank is arranged within the parallelepiped defined by the support structure and that the thermal insulation jacket with the circular cylindrical tank skin in cross-section forms crescent-shaped ducts for carrying the cooling or heating medium and which are longitudinally defined by the placing of the thermal insulation jacket on the tank skin in the corresponding vertical and horizontal plane (tangents in cross-section).

Due to the fact that the cross-section of the tank is as large as the square cross-section defined by the support structure, there is an optimum utilization of the cross-section made available through the container dimensions, i.e. through the corresponding standardization. The thermal insulation jacket is arranged as a separate shell in the vicinity of the tank. The tank merely has a somewhat different curvature (different radii), so that the crescent-shaped ducts are obtained for carrying the heating or cooling medium. Normally there is a cross-sectional formation of four such crescent-shaped ducts. Thus, there is a reduction in the volume ratio of the space made available by the container dimensions with respect to that of the tank, so that more liquid can be transported for the same container volume. Simultaneously and without additional components ducts for the cooling and heating medium are provided, through which in forced circulation the heating or cooling medium flows in such a way that a good heat transfer is ensured. As the thermal insulation jacket is in cross-section also substantially circular, less insulating material is used in its manufacture compared with the case of a square or other geometrical cross-section.

At the "critical points", i.e. in the vicinity of the vertical and horizontal planes, i.e. where the crescent-shaped ducts for carrying the heating and cooling medium are separated from one another, the thermal insulation jacket can be weakened somewhat in order to permit in said area an optimum space utilization, i.e. cross-sectional utilization. The compromise between the optimum space utilization and an adequate thermal insulation in such areas and accompanied by an adequate thermostatic control, is obtained through the crescent-shaped construction of the ducts.

Advantageously and as claimed in claim 3, condensation water lines can be provided, so that the condensation water formed in the upper ducts is drained into the lower ducts and can be conveyed away at the lowest point.

As defined in claims 4 and 5, it is fundamentally possible to arrange the tank between the end faces either on feet, or to fix it between the faces with the aid of corresponding components and to obviate feet or similar supports.

Figure 1:
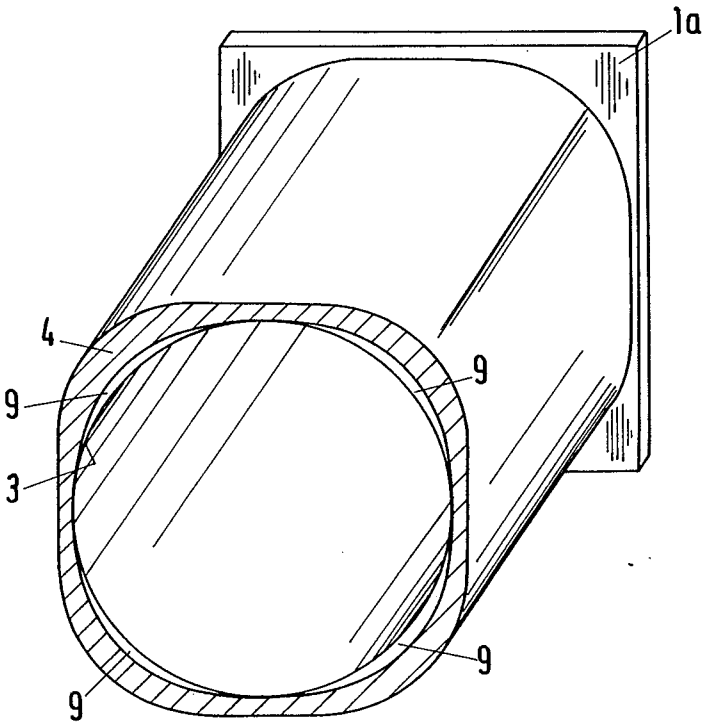

Between the connecting ring and the support ring, it is possible to arrange a ring made from poor thermal insulating material, so as to prevent "heat or cold bridges" in this area. The invention is described in greater detail hereinafter relative to two embodiments and with reference to the attached drawings, wherein show:

FIG. 1, A perspective view for illustrating the principle of the invention.

Figure 2:
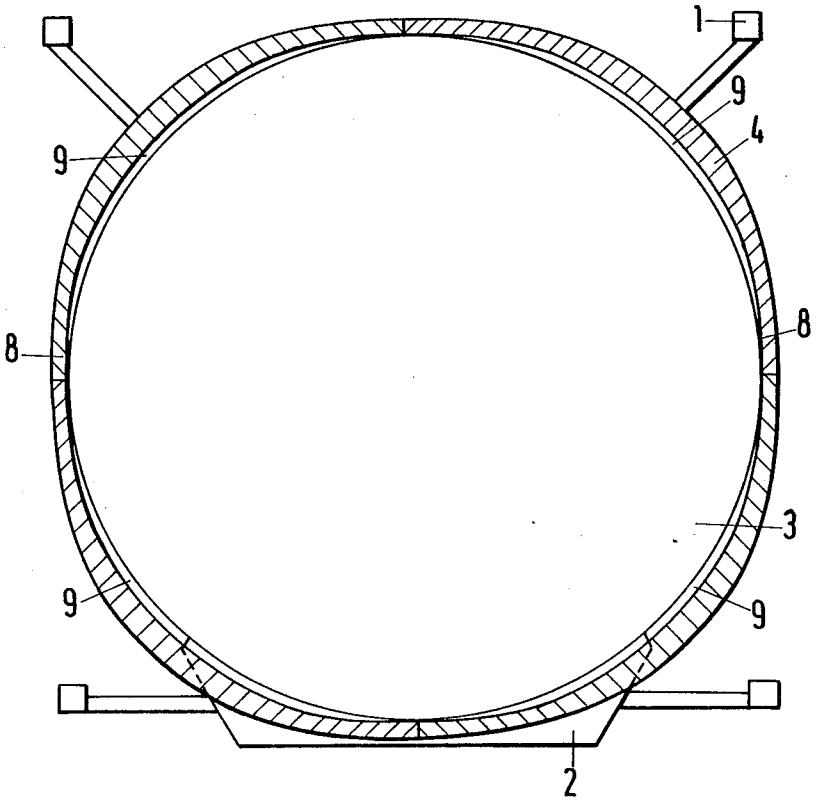

FIG. 2, A cross-section through an embodiment of a tank container according to the invention.

Figure 3:
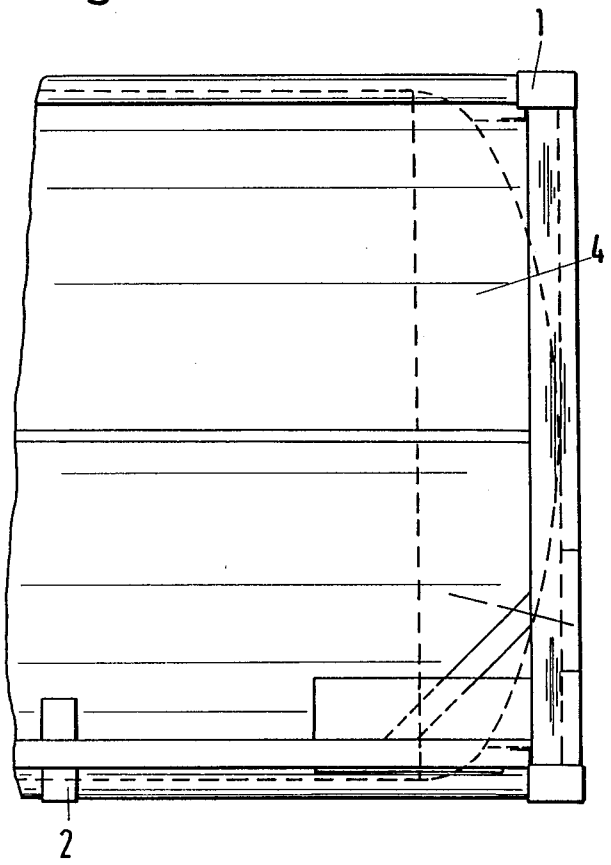

FIG. 3, A cut off side view of the tank container according to FIG. 2.

FIG. 4, A cross-section through a tank container of another embodiment.

Figure 5:
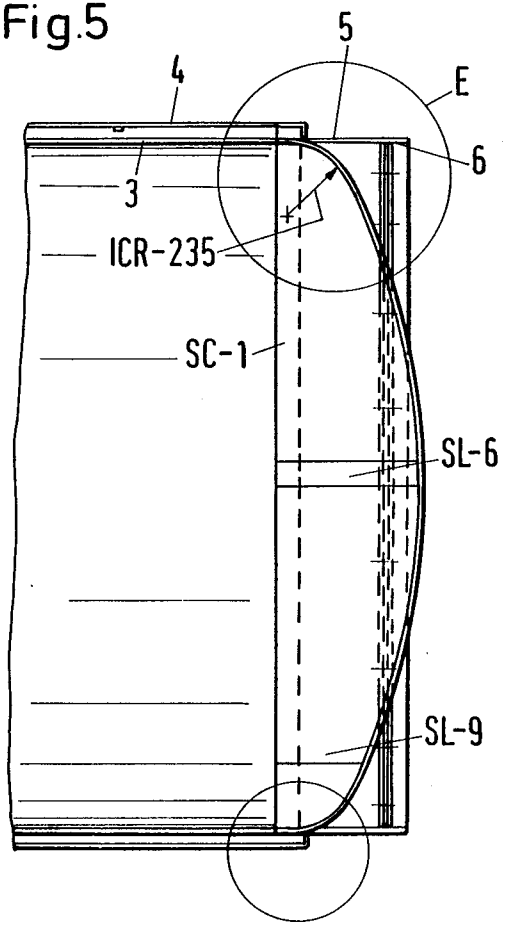

FIG. 5, A cut-off side view of the tank container according to FIG. 4.

Figure 6:
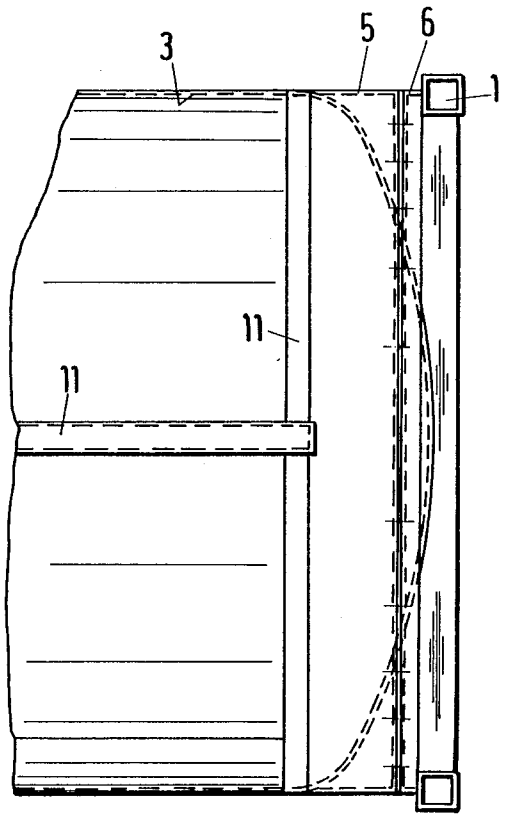

FIG. 6, A plan view of the tank container according to FIGS. 4 and 5.

Figure 7:
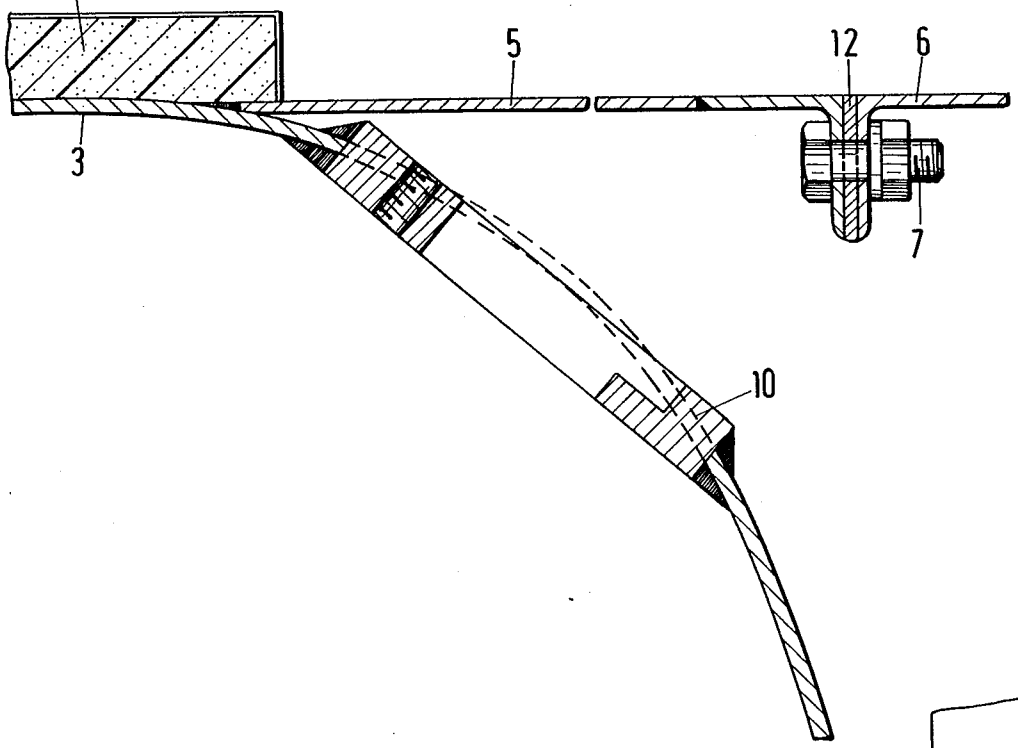

FIG. 7, Detail E of FIG. 5 on a larger scale.

Figure 8:
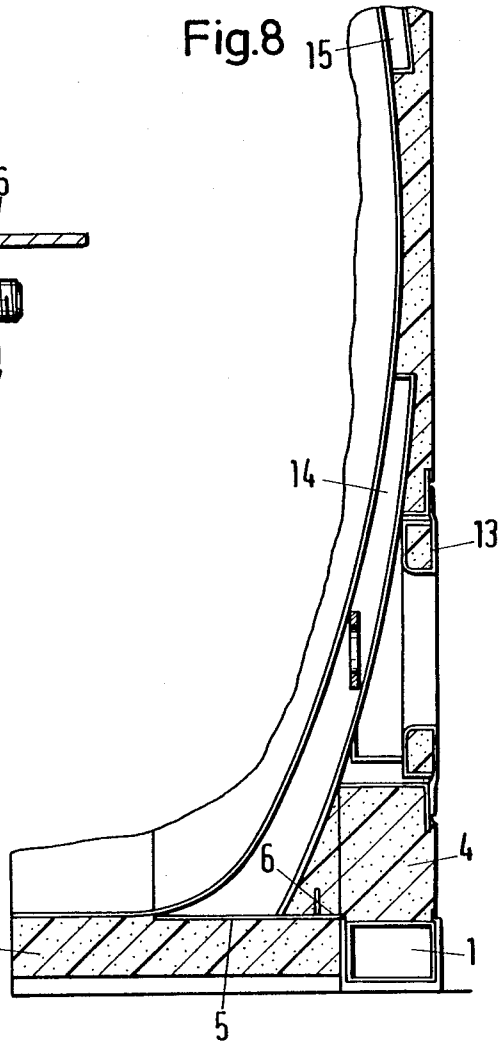

FIG. 8, A detail for illustrating the entry of the cooling or heating medium and the arrangement of the insulation in the vicinity of the end faces. FIG. 1 shows the tank container according to the invention in perspective, merely with its essential components. The frame structure is indicated by a frontal plate 1*a*, the tank 3 being fixed between two such plates. Tank 3 is surrounded by a thermal insulation jacket 4. It can be clearly seen that through the placing of the thermal insulation jacket 4 in the vicinity of the vertical and horizontal planes on tank 3, four crescent-shaped, longitudinally directed ducts 9 are formed for carrying the heating or cooling medium. The thermal insulation jacket 4 is made somewhat weaker or thinner at the placement surfaces, so as to bring about an optimum utilization of the size fixed by the square cross-sectional shape of the standarized container.

FIGS. 2 and 3 show an embodiment of a thermostatically controllable tank container with a supporting structure 1. The latter forms a support frame with frame-like end faces, which define a quadratic surface. In the support frame is arranged a tank 3 having a circular cross-section and as can be gathered from FIGS. 2 and 3. The tank skin of tank 3 fills the square cross-section fixed by the frame structure 1 to the maximum extent possible from the practical standpoint. The dimensions of the support structure correspond to the standard container. In the embodiment the tank 3 is carried by feet 2, which are connected to support structure 1.

A substantially circular thermal insulation jacket 4 is arranged around tank 3. In areas where adequate space is available, the jacket 4 has a somewhat more pronounced curvature (smaller radius), so that here there are four longitudinally directed, cross-sectionally crescent-shaped ducts 9, as can be clearly gathered from FIGS. 1 and 2. These ducts 9 are used for the forced circulation of the heating or cooling medium, which is supplied and removed at the connections on one face. On the insulated end faces corresponding cavities are provided, through which is correspondingly passed the heating or cooling medium. At the inlet connection, the heating or cooling medium passes into a cavity, which is connected to the two other ducts through which the heating or cooling medium flows to the other face. In this area is provided a through cavity, which ensures that the heating or cooling medium enters the two upper ducts 9 and flows back to the starting face. At the latter it enters an upper cavity, which is separated from the lower cavity. Into said upper cavity passes a connection, which permits the discharge from the tank container of the heating or cooling medium.

It becomes clear on considering FIG. 1 that the thermal insulation jacket 4 is weakened somewhat in the vertical and horizontal planes i.e. at the "critical points", for the optimum utilization of the square cross-section of support frame 1. The thickness of the thermal insulation jacket is somewhat reduced here and as a result the tank can be made somewhat larger. In order to permit a technically sensible compromise between an optimum space utilization and an adequate thermal insulation, use is made of crescent-shaped ducts for which adequate space is available in the corner regions of the square cross-section.

Between the superimposed crescent-shaped ducts 9 for the forced circulation of the heating and cooling medium are provided condensation water lines 8 (FIG. 2), which are formed during the manufacture of the thermal insulation jacket by the insertion of tubes or the like. The condensation water can run out of the upper ducts 9 into the lower ducts 9, so as to be collected and drained off.

The invention leads to a thermostatically controllable tank container bring about an optimum utilization of the inner area resulting from the support structure or standardization, whilst retaining the circular crosssection of the tank. The thermal insulation jacket takes up a relatively small surface. The ducts for the heating and cooling medium are created where, when taking account of the circular cross-section of the tank, adequate space is available without impairing the space utilization for the tank.

The embodiments according to FIGS. 4 to 8 differ from those according to FIGS. 2 and 3 in that there are no feet.

Tank 3 is fixed between the end faces, which can be in frame or plate-like form. This takes place on each face with the aid of a connecting ring 5, which is welded to the tank skin. A flange of a support ring 6 is fixed to the flange of said connecting ring 5 by screws 7. Support ring 6 is connected to the faces of the support structure 1. The construction is made readily apparent on considering FIG. 7, which also shows a flange 10 for receiving fittings.

As can also be gathered from FIG. 7, between the connecting ring 5 and the support ring 6 is provided a ring 12, which is made from a poor heat insulating material. The only connection between tank 3 and support structure 1 is via the connecting ring 5, which can also be referred to as a connecting jacket.

As ring 12 is arranged between connecting ring 5 and support ring 6, said single "heat or cold bridge" is interrupted, which improves the tank insulation.

FIG. 8 shows a detail of a sectional side view in one lower corner and on a larger scale of the embodiment according to FIGS. 4 to 7. It is possible to see the thermal insulation jacket 4 in the vicinity of the end face. In this representation the thermal insulation jacket has an opening, which is closed by a cover 13. This opening is used for the entry of the heating or cooling medium into a cavity 14, which is connected to the two lower ducts 9. At the top of FIG. 8 is provided a corresponding cavity 15, which is connected to the two upper ducts 9 and has a not shown opening for the outflow of the heating or cooling medium. It can also be gathered from FIG. 8 that the two cavities 14 and 15 are separated from one another. The other end face does not have this separation apparent in FIG. 8, so that only one cavity is provided through which the heating or cooling medium can pass from the lower ducts 9 into the upper ducts 9.

The cylindrical thermal insulation jacket 4 is mounted in the form of "half-shells" on the tank. The two half-shells with an approximately semicircular cross-section are engaged laterally and then interconnected. As the tank contour is correspondingly long, several half-shells are mounted in its longitudinal direction and interconnected by circumferentially directed rings. On the end faces the thermal insulation jacket 4 is then constructed in the manner shown in FIG. 8, whereby on one end face are provided inlets and outlets for the heating or cooling medium with the separate cavities 14 and 15 and on the other end face are provided the corresponding deflecting cavity.

We claim:

1. Thermostatically controllable tank container with a support structure (1), which fixes the external dimensions of a parallelepipedic container and serves as a support for a circular cylindrical tank with a non-supporting thermal insulation jacket in the vicinity of the outside of the tank and in which between the tank skin and the thermal insulation jacket ducts are provided for carrying a cooling or heating medium along the tank skin serving as a heat exchange surface, characterized in that the external diameter of the circular cylindrical tank (3) substantially corresponds to the internal dimensions of the square cross-section of the support structure (1), that the thermal insulation jacket (4) adapted to the contour of the circular cylindrical tank is arranged within the parallelepiped defined by the support structure (1) and that the thermal insulation jacket (4) with the circular cylindrical tank skin in cross-section forms crescent-shaped ducts (9) for carrying the cooling or heating medium and which are longitudinally defined by the placing of the thermal insulation jacket (4) on the tank skin the corresponding vertical and horizontal plane (tangents in cross-section).

2. Thermostatically controllable tank container according to claim 1, characterized in that in the vicinity of placing (vertical and horizontal plane) the thermal insulation jacket (4) on the tank skin, the thermal insulation jacket material is weakened.

3. Thermostatically controllable tank container according to claims 1 or 2, characterized in that the superimposed, crescent-shaped ducts (9) for the heating or cooling medium are interconnected by condensation water lines (8).

4. Thermostatically controllable tank container according to any one of claims 1 to 3, characterized in that the tank (3) rests on feet (2) between the end faces of support structure (1).

5. Thermostatically controllable tank container according to any one of claims 1 to 3, characterized in that the tank (3) is fixed with the aid of connecting and/or support rings (5, 6) between the frame or plate-like end faces of support structure (1).

6. Thermostatically controllable tank container according to claim 5, characterized in that between the connecting ring (5) connected to tank (3) and the support ring (6) connected to the associated frame or plate-like end faces of support structure (1) is provided a ring (12) made from poor heat conducting material.

* * * * *